US010997830B1

(12) United States Patent
Thayer

(10) Patent No.: US 10,997,830 B1
(45) Date of Patent: May 4, 2021

(54) ELECTRONIC SIGNALING DEVICE

(71) Applicant: David B. Thayer, Bradenton, FL (US)

(72) Inventor: David B. Thayer, Bradenton, FL (US)

( * ) Notice: Subject to any disclaimer, the term of this patent is extended or adjusted under 35 U.S.C. 154(b) by 0 days.

(21) Appl. No.: 16/867,531

(22) Filed: May 5, 2020

(51) Int. Cl.
*G08B 5/36* (2006.01)
*B07C 3/14* (2006.01)
*B07C 3/00* (2006.01)

(52) U.S. Cl.
CPC ..... *G08B 5/36* (2013.01); *B07C 3/00* (2013.01); *B07C 3/14* (2013.01)

(58) Field of Classification Search
CPC ..... G08B 5/36; B07C 3/00; B07C 3/14
USPC ..... 340/815.45
See application file for complete search history.

(56) References Cited

U.S. PATENT DOCUMENTS

2007/0102329 A1* 5/2007 Rosenbaum ..... B07C 3/14 209/584
2009/0223877 A1* 9/2009 Karnin ..... B07C 3/00 209/584
2015/0269617 A1* 9/2015 Mikurak ..... G06Q 50/12 705/14.54
2016/0042320 A1* 2/2016 Dearing ..... G06Q 10/08355 705/338
2020/0143322 A1* 5/2020 Dearing ..... G06K 7/10861

* cited by examiner

*Primary Examiner* — John A Tweel, Jr.
(74) *Attorney, Agent, or Firm* — Dorothy S. Morse

(57) ABSTRACT

A compact, time-saving and efficiency-promoting electronic signaling device that is programmable by its user to display a predetermined sequence of visual signals, corresponding to destinations, where independent and identified tasks are to be performed, such as but not limited to use in merchandise collection for order fulfillment or restocking distribution, multiple steps relating to product manufacture that are performed at different workstations, and office routing of items or documents to multiple locations for needed review and/or approvals. Preferred embodiments have a signal component that during use one-at-a-time displays a series of visual signals with different characteristics, each signal in the programmed sequence coded to identify a specific destination in an office, storage facility, or manufacturing plant. Once a task is completed, the user advances the device to the next task in the programmed sequence. Once all tasks are completed, the device may be user reprogrammed for a next use.

20 Claims, 3 Drawing Sheets

FIG. 3
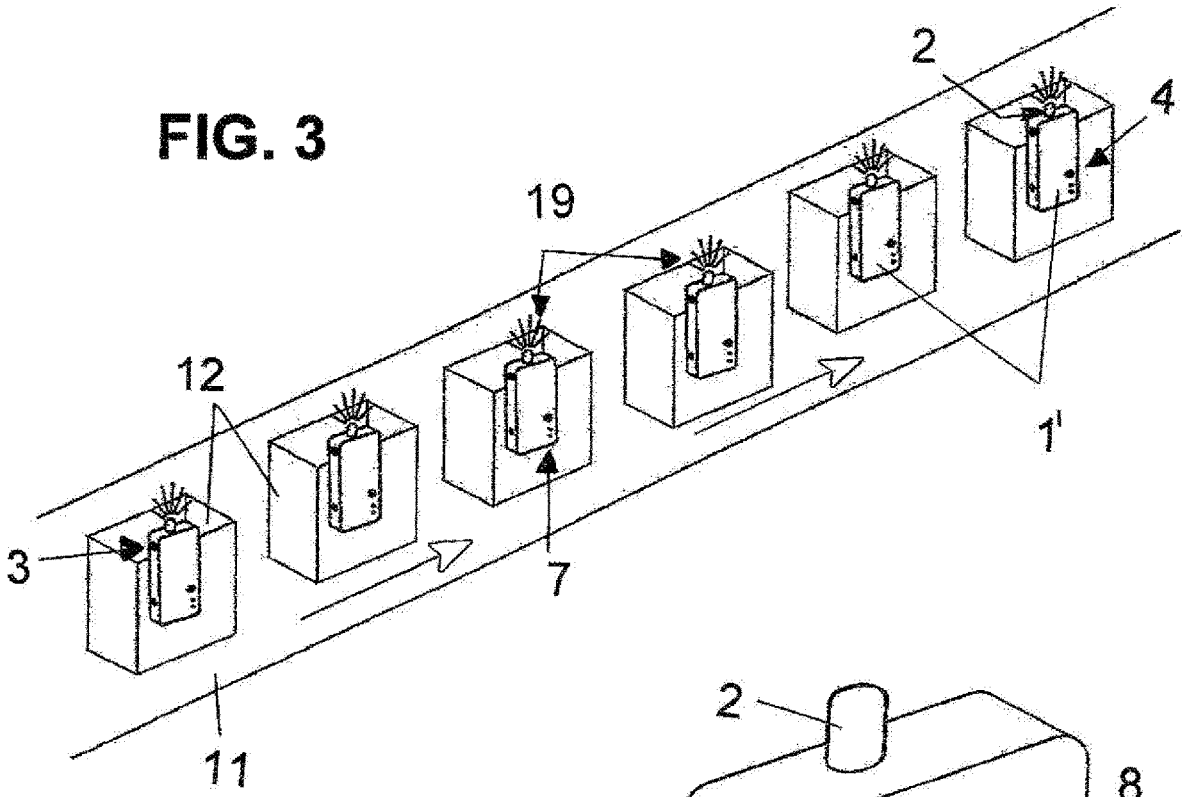
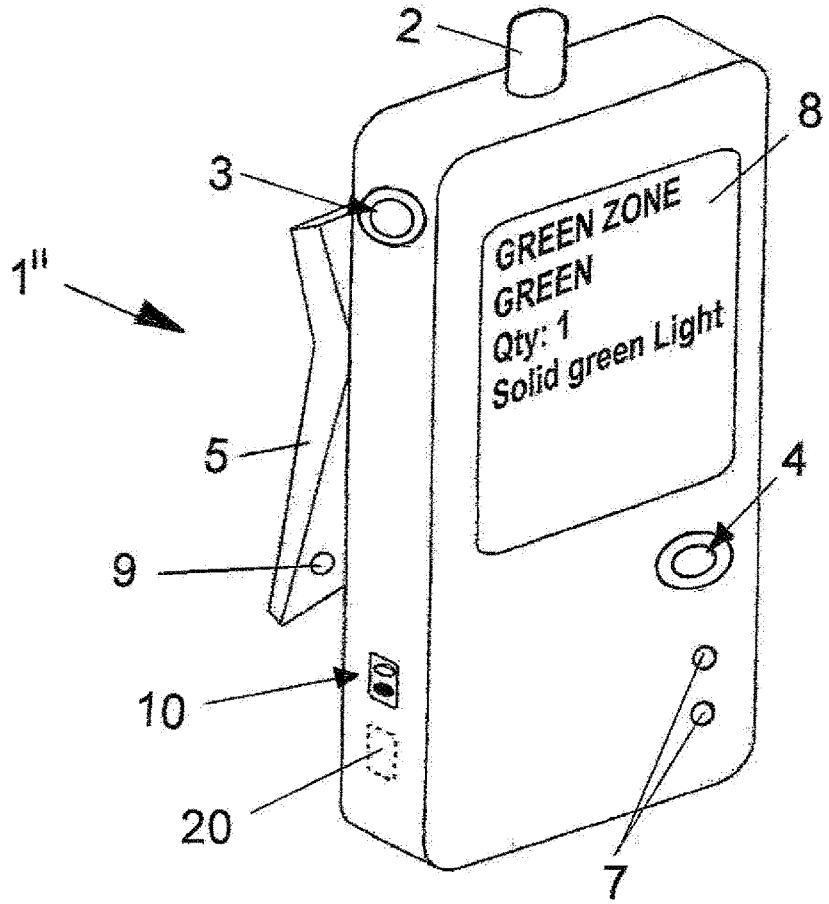
FIG. 4

ELECTRONIC SIGNALING DEVICE

CROSS-REFERENCES TO RELATED APPLICATIONS

None

BACKGROUND OF THE INVENTION—FIELD OF THE INVENTION

The invention herein relates to electronic devices that alert and inform a user, or multiple users, about a predetermined sequence of destinations, and may also identify one or more tasks or servicing to be performed at those destinations, specifically to a compact, time-saving, and efficiency-promoting electronic signaling device that is programmable by its user to display a sequence of highly visible and easily distinguishable visual signals each coded to correspond to a specific destination in a facility where at least one servicing/task is to be performed by a worker, workers, or the user, such as but not limited to use in merchandise collection operations for order fulfillment, merchandise stocking operations where distribution of items is needed from a receiving dock to 'bulk storage' or 'picking' areas, multiple steps relating to product manufacture that are performed successively at different workstations during the production or assembly of a component or product, and office/other routing of items or documents to multiple locations for review and/or needed approval. Visual signals produced by color programmable light emitting diodes (LEDs) are preferred in the most preferred embodiments of the present invention, but distinguishable visual signals produced in other ways by a conspicuously located and readily visible beacon are also considered to be within the scope of the present invention. If an embodiment of the present invention having an informational display is used, it can be programmed to also identify tasks or servicing to be provided by a worker, workers, or the user at each destination. Embodiments of the present invention without an informational display may travel through a facility accompanied by an article or container, an electronic pad, other small electronic device, written paperwork, or at least one scannable label, tag, or other means associated with an article or container that can be used to identify the tasks and/or servicing required sequentially at the predetermined destinations.

The most preferred embodiments of the present invention relate to business-to-business and business-to-consumer scenarios, and each present invention electronic signaling device has at least one visual signaling component (also referred to in this disclosure as a beacon) that during use of the present invention sequentially displays a series of visual signals with different and easily distinguishable characteristics, such as but not limited to those with different colors, different colors in combination with variations in light intensity, various flashing characteristics, a variety of blinking patterns/arrangements, and/or different solid and blinking patterns/arrangements that include display of more than one color. Each visual signal included in a programmed sequence is coded to identify a specific destination in a business, retail store, office, storage facility, manufacturing plant, or other large facility. Multiple codes for the same destination can be included in any programmed sequence, depending upon the application and need. Advancement from one visual signal in the programmed sequence to the next one in the sequence that is coded for a different destination, is simply accomplished by a worker at each destination after the task or servicing performed there has been completed. The current worker also initiates an appropriate mode of travel to route the present invention device (while displaying its newest visual signal) and an associated container or item to the next predetermined destination, so that the user (or others) can accomplish the next required fulfillment or manufacturing task, or other servicing (such as, but not limited to, merchandise collection for fulfillment of orders, merchandise stocking operations, routing of office documents or items to multiple locations for review and/or approval, and manufacturing steps performed in sequence at different workstations). When a user completes the current task and engages a function control button to advance the device to display a new visual signal, if no new visual signal appears, the lack of signal indicates that all programmed activity has been completed, and the device may then be reprogrammed for a next use.

The present invention electronic signaling device may be transported by a single user through a facility or office to the next destination in its currently programmed sequence (where the next task or tasks are to be performed), with that user conducting the servicing at all of the predetermined destinations stored in the device. If the present invention also has an information display, the task to be performed may also be identified by the device (otherwise the task may be identified in accompanying paperwork, a scannable bar code label or tag, or other suitable means). In the alternative the present invention can be used in a multi-worker application where it is passed from worker to worker after each worker has completed the specific task or servicing assigned. In multi-worker applications, the present invention may be routed through an office, or other facility, in association with an item during its manufacturing steps, in association with documents routed for review and/or approval via automated or manual transport means, or in association with a box, container, bag, rack, bin, cart, pallet, skid, and/or truck and optionally a conveyor or other automated transport system. Present invention devices may also comprise a mounting component, such as but not limited to a movable or non-movable clip, allowing their temporary and easily releasable attachment to a file, article, container, product during its manufacture, or other item. Multiple present invention electronic signaling devices may be simultaneously routed through a facility. Present invention devices may be routed to the same destination in a facility more than once (such as in manufacturing for items needing additional work or inspections). When used with an automated transport system it is preferred that the present invention device is secured in a conspicuous position on an item or container that allows 360-degree visibility of its beacon's visual signal from a minimum distance of approximately ten feet.

BACKGROUND OF THE INVENTION—DESCRIPTION OF THE RELATED ART

In a number of business-to-business and business-to-customer scenarios, things may need to move from station to station, person to person, or "zone" to "zone", for servicing and/or the performance of at least one human or robotic action. This is especially true of a "picking" process, when a customer has ordered multiple items from a company and the company then needs to fulfill the order efficiently. Movement within a facility may also be needed for a manufacturing process that requires a number of steps at different workstations for efficient production or assembly of the final product. Studies have shown that the most efficient method for performing a non-sequential series of tasks (where tasks need to be performed only at some of the zones or workstations available, but not all of them) is to move the order/item/batch from its existing location directly to the next location that requires action, typically performed by a different individual or team (and skipping one or more interim stations located between the original and final destinations), instead of having the order/item/batch pass through each location in the facility where workers there are required to spend time reviewing information and independently determining whether they are required to perform any servicing action before advancing the order/item/batch to the facility's next workstation, with the steps of reviewing information and determining whether servicing action is required potentially being repeated many times by interim stations with no service obligation until the next servicing destination is reached.

The present invention has been designed for use in fulfillment and industrial situations with the objective of improving the "picking process" efficiency in each. In a fulfillment application, the terms "Pick and Pass" and "Zone Pick" are used to refer to methods of fulfilling orders where only a small percentage of zones in a facility are required to fulfill an order relative to the total number of zones available in the facility. In a manufacturing facility, the "next workstation required" is a commonly used term (instead of "zone"), and one or more inspections may also be required before a partially manufactured or assembled product is advanced to the next workstation where further manufacturing steps or assembly take place.

To promote efficient use of interior space and operation, each area of a store, warehouse, or manufacturing facility typically has different workers dedicated to specific items or tasks. In a grocery store, there are meat specialists, produce specialists, deli specialists, bakery specialists, etc. In department stores, there are men's specialists, women's specialists, makeup specialists, footwear specialists, electronics specialists, sports equipment and clothing specialists, toy department specialists, housewares specialists, etc. In a warehouse environment, there are zone specialists who know the items in their area, and can pick and/or restock them faster than non-specialists. In a manufacturing environment, there are drill presses, milling machines, lathes, inspectors, etc., all at workstations with different skilled operators. Ideally, and for maximum efficiency in all of these facilities and scenarios, orders should pass from one zone directly to the next one where servicing action is required, and should always bypass zones where no activity is needed, but often with prior art systems and methods in current use, direct routing does not always occur.

A first example demonstrating inefficiency inherent in a prior art "picking" process relates to a company selling products on-line and shipping them directly to its customers. For purposes of this example, it is assumed that the company has a large number of items to sell and stores them in Zones in a large warehouse, with each order traveling through the entire warehouse on a conveyor system in succession from its first Zone 1 to its final Zone XX. In addition, a majority of its customers' orders (collected via cart/bin/bag/box/pallet, skid, truck, or the like) will need NOTHING from some of the Zones in the warehouse, and many will need items from only a few Zones, yet workers in each Zone are required to handle every order to check whether or not it needs one or more items from that location. After retrieving all needed order fulfillment items from a Zone and adding them to an order, or doing no order fulfillment activity at all, the workers in Zones 1 to Zone XX return the order to the conveyor system for advancement toward order completion and the final Zone XX, whether or not a fulfillment item was actually needed from each interim Zone and repeatedly wasting worker time in each instance where the order is handled/processed in an interim Zone while no fulfillment items are added. Thus, when very few customers of a company place an order that requires fulfillment items from every location, each time the order must stop at Zones unrelated to the order fulfillment, the efficiency of the company's "picking" process decreases.

A second example of inefficiency in prior art "picking" methods is a grocery store scenario where a customer is able to order on-line for in-store pickup, and may need a variety of frozen items, a variety of refrigerated items, and a variety of dry goods. In addition, it is assumed that most orders will not require something from every aisle. Store employees are needed to gather items for order (cart) fulfillment, items in the orders are most frequently found in different aisles of the store, and even if items are in the same aisle they are often in different parts of the aisle (zones). When most of the on-line orders received by a grocery store require items from only a few zones in the store, employee "picking" by common prior art processes is very inefficient as while seeking needed items to complete an order store employees are typically routed through a large number of aisles or zones devoid of order fulfillment items.

A third example of inefficiency in prior art "picking" processes predating the present invention is a manufacturing scenario in which a facility has twenty different specialty machines that each performs a different function, and to complete a product's manufacture or assembly it must advance through the facility from one machine to the next in a predefined order until all servicing action is completed. When all products made in the facility require service from each of the twenty machines in the same predefined order, advancement of partially assembled products through the facility can be adapted for optimal efficiency. However, when some of the products made in the facility do not require service from all twenty machines, or require a different order of service from the twenty machines than other products manufactured or assembled at the same facility, or if one or more interim inspections occur, products can require rerouting for additional service to one or more of the twenty machines, advancement of partially completed products in the facility to a next required workstation becomes more inefficient each time the partially completed product stops at an interim workstation unrelated to the next servicing action required and some type of worker handling is required, instead of the product being directly advanced to the workstation where servicing action is needed (as is possible through use of the present invention).

As identified in the three above examples, many prior art routing systems and methods currently used require the passing of an item or order to all workstations or zones in a facility, from one individual or team to a next one in succession, regardless of whether servicing action by that next individual or team results in activity related to order fulfillment or provides a next required step in a manufacturing process, instead taking worker time to handle the order or item only to pass it along to others for the needed fulfillment, manufacturing action, or other servicing. As a consequence, many individuals or teams in the facility must review information about each order or item arriving at their workstation, and then advance that order/item to the next workstation (which may also be an interim one) in a predetermined succession for the same informational review and potential advancement by one or more additional interim workstations, without the majority of those workstations ever conducting an order fulfillment, product manufacturing action, inspection, or other servicing. This overly inclusive practice of an order or item visiting each successive individual or team in a facility, whether or not any fulfillment or manufacturing action by that individual or team is required, decreases operational efficiency by involving worker time that could be more efficiently applied to another beneficial activity. Furthermore, businesses typically do not want individuals independently moving through a plant, facility, store, or warehouse to acquire items for a single incoming order or taking an incompletely manufactured product to its next workstation for an additional manufacturing step, so the establishment of zones has been preferred. In the alternative, if all workers in a facility whose assistance is needed for completion of any task or order could at the end of their involvement with an order or item simply press a single advancement control on a preprogrammed device traveling with the order or item throughout the facility and thereby cause that device to identify the next destination where that item or order will receive its next required servicing action, the item or order would reach the next required workstation without any interim stops, and if the facility comprises an automated means by which to send the item or order directly to that next required destination, the "picking" process would be made more efficient and significantly improved.

The visual signaling device of the present invention offers businesses an opportunity to increase efficiency in business-to-business and business-to-customer scenarios, addresses a presently unfulfilled need, and is not currently known in the prior art. In the above-identified grocery store example, if the order (shopping cart) starts in aisle 1, and the aisle 1 operator has finished locating the required item or items and placed them into the cart, how does that worker know where the cart needs to go for the next needed item(s) without looking at a written document or an electronic screen to learn that the next activity is required in aisle 5? If the aisle 1 operator then simply places the shopping cart on an automated conveyor for movement toward aisles 2-4, and its next stop is actually at aisle 5 (where the next fulfillment activity is required), how would the aisle 2, 3, and 4 operators approached by the shopping cart know to ignore it? Time used by the operators in aisles 2-4 to handle that shopping cart without any direct order fulfillment role in servicing it is inefficient, non-productive, and wasteful. Using prior art order advancement methods, the operators at each interim aisle (where no fulfillment activity is scheduled) would each have to take time to scan written information (or view an electronic screen), and thereafter in succession pass the shopping cart (without adding any items to it) to the next aisle in sequence, even though the operators in the next two aisles thereafter will also have to do the same review and forwarding activity without adding any items to the shopping cart, the unnecessary and repetitive effort wasting valuable time that could be put to more productive use.

The above examples describe a common problem that the present invention solves. Business operations are often organized into zones, with a single picker or operator responsible for his/her zone. Shipping boxes or carts for temporary storage of items during order propagation are then routed either along a conveyor line or on wheeled carts, and the operators in the zones need to identify which items from the conveyor or cart need to be serviced in their zone. The present invention employs a means whereby when an order to be worked is released into a facility, a preprogrammed electronic visual signaling device with at least one lighted beacon conspicuously located for optimum visibility is attached to a propagating box/cart or group of boxes/carts while displaying one-at-a-time one or more lighted visual signals that are readily observable, easily recognized by, and coded specifically for, a first operator (and for subsequent operators as well, if needed) responsible for procuring the required item or service. The visual signal must be easily viewable and interpreted from a distance of at least ten feet. However, it may also be viewable from a hundred feet away, or more, if desired.

The value of the present invention is that, unlike most of the current prior art order conveyance methods and systems, operators in all zones never need to check individual boxes/carts/containers using a barcode scanner or other "close interface" means to identify whether servicing by that zone is needed. Instead, with the present invention use when the operators see their distinctive/assigned lighted visual signal approaching their zone (via a zone-dedicated color, light intensity, flashing characteristic, and/or a blinking sequence), each operator promptly recognizes the need to provide "service" for the item or container associated with the present invention device. Referring back to the above-mentioned grocery store scenario where items are required only from aisles 1 and 5, workers in aisles 2, 3, and 4 immediately know to ignore carts not displaying their zone-dedicated visual signal, the lack of which confirms that there is no current servicing action required on their part.

The most preferred embodiments of the present invention are compact and user programmable devices that each can be electronically actuated to display a distinctive and dedicated visual signaling output from at least one conspicuously located beacon, that is visually observable by operators in a business-to-business or business-to-customer facility from a distance of at least ten feet. The visual signaling output may comprise one or more programmable multi-color light emitting diodes (LEDs) that identify a task or service required at a specific destination. The present invention device is typically programmed first (but not limited thereto), and then associated with a bag/box/container/cart/skid/pallet/file folder containing documents for review and approval/and similar items or articles. The facility may be set up using a color gradient system so that aisle 1 is red, with aisle 2 orange, aisle 3 yellow, aisle 4 green, aisle 5 blue, with additional aisles distinguishable by other lighting characteristics, such as light intensity and blinking or flashing patterns, but is not limited thereto. As soon as the present invention device is programmed and turned on, the zone-dedicated light characteristics coded only for the first destination are promptly displayed, and all operators able to view it from their workstations or zones will know when the item or order needing their services is headed their way. In the grocery store example, in reference to Zone 1 (aisle 1) the light sequence displayed would first show a red visual signal, and then a blue visual signal (for Zone 5). Once the activity needed in Zone 1 is completed, the operator in Zone 1 engages or actuates a human interface (function/control button) on the compact present invention device, and immediately thereafter the beacon's visual output will turn blue, indicating that the next servicing activity occurs in Zone 5. The operators in aisles 2-4 will then let the advancing cart/bag/box/container pass by them, while doing nothing. When Zone 5 is reached, its operator will instantly recognize the zone-dedicated blue visual signal and intercept the cart/bag/box/container, thereafter performing the required servicing activity. Once the Zone 5 activity is finished, the Zone 5 operator also engages the human interface/button to identify whether the order fulfillment is complete, or if the present invention's beacon will promptly display the zone-dedicated characteristics of a destination where the next activity must be performed. If the beacon's visual signaling output ceases, servicing is complete. No invention is currently known to have all of the benefits and advantages of the present invention.

SUMMARY OF THE INVENTION

The primary objective of this invention is to provide a compact, easily portable, battery operated, efficiency promoting, and user reprogrammable device that can successively identify, note, and/or inform one operator (or successively identified operators) of a sequence of destinations in business-to-business and business-to-customer scenarios with different, distinctive, and zone-dedicated lighted visual signaling output coded specifically for each destination in a preferred sequence, and may also identify the servicing task or tasks to be performed at each destination. A further object of this invention is to provide a visual signaling device effective in scenarios that include merchandise collection for order fulfillment, merchandise stocking operations where distribution of items is needed from a receiving dock to 'bulk storage' or 'picking' areas, multiple steps relating to product manufacture that are performed successively at different workstations, and office/other routing of items or documents to multiple locations for needed review and/or approvals. It is also an objective of this invention to provide a visual signaling device that can be prominently and conspicuously displayed for observation at least ten feet away, and more than one hundred feet away where appropriate or desired. A further object of this invention is to provide a visual signaling device that may have visually distinguishable light intensity, as well as color and blinking or flashing characteristic. In addition, it is an objective of this invention to provide a visual signaling device that may optionally include a display screen. It is also an objective of this invention to provide a visual signaling device that optionally includes a means of easily-releasable mounting to an associated item or container advancing through a facility on an automated conveyance system, on wheeled carts, or other transport system. Another object of this invention is to provide a visual signaling device that has a charging status indicator. In addition, it is an objective of this invention to provide a visual signaling device having a programming port, either wired or wireless.

The present invention is an electronic visual signaling device that can be easily associated with an item or container that successively needs servicing from multiple areas/locations in a business, retail store, warehouse, office, manufacturing plant, or other facility. Typical use would be fulfilling customer orders, restocking merchandise, or in a manufacturing facility where items are required to be moved from one workstation to another for successive processing. The most preferred embodiment of the present invention creates a diversity of highly visible light outputs from its beacon (or beacons) that each are coded to be distinguishable from one another and designate a different destination within the facility through which it is routed, so that only those needing to service the item or container with which the present invention is associated will need to handle it. For example, the signaling component (or multiple signaling components) of a present invention device may have a visual output with emitted light having different intensity and other characteristics, such as a solid red light, a solid blue light, a flashing green light with a uniformly synchronized on/off pattern, or a blinking light with a timed pause, such as a yellow light that repeatedly blinks three times, then has a two second pause before another pattern of three blinking yellow light outputs are displayed. Successively displayed and uniquely coded visual light patterns from its beacon (or beacons) lead the present invention to various workstations or zones, and continue to be displayed until the container or item associated with the present invention has been serviced by all necessary workers in the facility. When servicing at one location is complete, the operator there simply presses a function button to promptly advance the signaling component(s) output to display the dedicated characteristics coded for the next destination in the facility where it must stop for servicing action. The present invention is compact, but may have a variety of sizes and shapes, and is not limited to the configurations shown in the accompanying illustrations. The structure, advantages, and benefits provided by the present invention disclosed herein are not known in the prior art.

BRIEF DESCRIPTION OF THE SEVERAL VIEWS OF THE DRAWINGS

FIG. 3 is a perspective view from the front of a plurality of second preferred embodiments shown in FIG. 2, each associated with a different container on an automated conveyor system so that its lighted beacon is prominently and conspicuously displayed for easy viewing.

FIG. 4 is a perspective view from the front of a third preferred embodiment of the present invention signaling device with a top beacon, forward and backup function buttons, and at least one indicator light that are similar to those shown in FIGS. 1 and 2, and a rear mounting device in the form of a clip that is similar to that shown in FIG. 1 and the wireless programming port shown in FIG. 2, and additionally showing a display screen on its front surface that provides information about the destination and/or task to be performed, as well as a charging contact on its clip.

COMPONENT LIST

Figure 1:
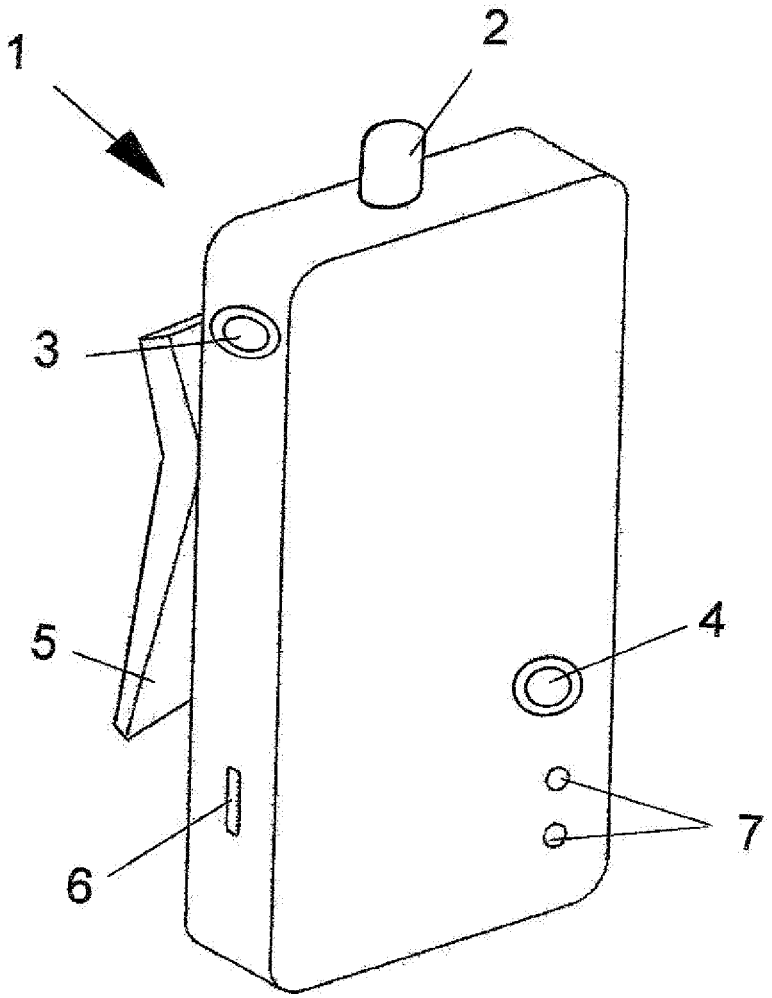
FIG. 1 is a perspective view from the front of a first preferred embodiment of the present invention signaling device having a top signaling component (or beacon), forward and backup function buttons, at least one indicator light, a port for wired charging and programming, and a rear mounting/attachment device in the form of a clip.

1—Electronic Signaling Device (first preferred embodiment is wireless, has Mounting Clip 5, and does not have Information Display 8)

1'—Electronic Signaling Device (second preferred embodiment is wireless and has no Mounting Clip 5 or Information Display 8)

1"—Electronic Signaling Device (third preferred embodiment is wireless, has Mounting Clip 5, and also has Information Display 8)
2—Electronic Signaling Device Beacon (preferably uses programmable color LEDs)
3—Function Control Button for ON, OFF, Advance
4—Function Control Button for Backup
5—Mounting Clip (movable or non-movable)
6—Port for wired charging and programming (preferably a USB port)
7—Indicator lights (usable to indicate charging status)
8—Informational Display (can identify servicing requirements and other information)
9—Charging Contact
10—Port for wireless programming
11—Automated Conveyor System
12—Abstract representation of an item or container used for support of Electronic Signaling Device 1, 1', 1", or other (such as but not limited to a bag, box, bin, cart, pallet, skid, truck, document holder, or other article/item/container that is to be serviced by making at least one addition to it; serviced by removal of at least one item, thing, or component; serviced by inspecting at least one item, thing, or component; serviced by performing another operation relative to at least one item, thing, or component, such as but not limited to document review and/or approval; and/or service comprising successive performance relative to at least one item, thing, or component from multiple work stations or operating locations)
13—Performance Zone or Workstation A
14—Performance Zone or Workstation B
15—Performance Zone or Workstation C
16—Performance Zone or Workstation D
17—Storage Shelves or Bins (location identified through programming of Electronic Signaling Devices 1, 1', 1", or other, that causes at least one Beacon 2 to create in succession a sequence of Visual Signal Outputs 19 each with distinguishable characteristics that are coded for a different Performance Zone or Workstation 13, 14, 15, 16, or other)
18—Aisle (space between Storage Shelves or Bins 17 for worker movement during servicing activity directed toward Articles/Items/Containers 12)
19—Distinctive Visual Signal from Beacon 2 (coded for a specific destination in a large facility and preferably with up to 360-degree visibility from a distance of at least ten feet, but adjustable for visibility from one hundred feet or more, if needed)
20—Power Source (preferable rechargeable battery)

DETAILED DESCRIPTION OF THE INVENTION

The present invention discloses a visual signaling device (1, 1', 1", or other) offering businesses an opportunity to increase efficiency in business-to-business and business-to-customer scenarios, and its most preferred embodiments comprises a compact and user programmable device (1, 1', 1", or other) that can be electronically actuated and advanced to display a distinctive and dedicated visual signaling output from a signaling component 2 that is visually observable by operators (not shown) at least ten feet away (and at one hundred feet away, if appropriate). The visual signaling output from a signaling component 2 may comprise one or more programmable color light emitting diodes (LEDs) that identify a task or service required at a specific destination (such as, but not limited to, performance zones 13-16 in FIG. 5). The device (1, 1', 1", or other) is typically programmed first, and then associated with a bag/box/cart/skid/pallet/or other item or container 12. A facility in which the present invention device (1, 1', 1", or other) is used may be set up in a similar manner to that shown in FIG. 5, so that one or more aisles 18 between storage shelves or bins 17 in Performance Zone 13 are coded with a red signaling output 19, with one or more aisles 18 between storage shelves or bins 17 in Performance Zone 14 being coded with an orange signaling output 19, one or more aisles 18 between storage shelves or bins 17 in Performance Zone 15 coded for display of a yellow signaling output 19, and one or more aisles 18 between storage shelves or bins 17 in Performance Zone 16 coded with a green signaling output 19. As an alternative thereto, each aisle 18 in one or more Performance Zones (13, 14, 15, 16, or other) could be coded to respond to a visual signal output 19 with different lighting characteristics, including but not limited to blinking or flashing, variations in light intensity, variations in displayed color, and/or use of multiple beacons 2. As soon as the device (1, 1', 1", or other) is programmed and turned on using function control button 3, the zone-dedicated light output 19 for the first destination is promptly displayed, and all operators able to view it from their workstations or zones will know whether the item or order is headed their way for the performance of a needed task or service. Once all activity is finished at each workstation or zone, and the human interface/button 3 is activated by the operator just completing the activity, the lighted visual signal output 19 of the present invention beacon 2 will then promptly display the programmed and zone-dedicated characteristics of the destination where the next activity must be performed, or the visual signaling outputs 19 will cease, identifying that all action at the destinations in the preprogrammed sequence have been completed. The value of the present invention is that, unlike most present practices, operators in all zones do not need a "close interface" check of individual boxes/carts using a barcode scanner or other "close interface" tracking means. If they see their zone-dedicated visual signal 19 providing a uniquely coded color and/or a blinking sequence, they know that they need to provide a service for the associated item.

To alert operators from at least ten feet away, the most preferred embodiments of the present invention use a programmable color LED in its visual signaling component 2. Once the device (1, 1', 1", or other) is programmed, it is attached to a box, cart, skid, carton, bag, truck, or item 12 needing additional manufacturing steps. The present invention can also be associated with documents or items (not shown) that must be routed through an office for reviews and/or approvals. As soon as the device (1, 1', 1", or other) is programmed and turned on using function control button 3, its beacon 2 becomes promptly illuminated with visual characteristics zone-dedicated for the first intended destination in the programmed sequence of destinations, and when the human interface with function control button 3 is again performed at the conclusion of servicing activity, the beacon or beacons 2 become illuminated with visual characteristics zone-dedicated for the next intended destination, or goes out to indicate that the programmed sequence is concluded. If a present invention device has two visual signaling components 2, at a single destination two beacons 2 could be illuminated for adjacent zones, and two workers (not shown) could be used to perform needed fulfillment or other tasks.

FIG. 1 is a perspective view from the front of a first preferred embodiment 1 of the present invention signaling device having a top signaling component 2, on/off/forward and backup function buttons (3 and 4 respectively), at least one indicator light 7, a port 6 for wired charging and programming, and a rear mounting/attachment device 5 in the form of a clip. The number, location, size, and configuration of top signaling component 2 is not considered limiting as long as it can be prominently and conspicuously displayed, nor is the exterior configuration of the present invention signaling device 1, which may instead have a circular or other cross-sectional configuration and, is not limited to the generally rectangular configuration shown in FIG. 1. In addition, the clip-shaped mounting device 5 shown in FIG. 1 could be larger or smaller than represented in FIG. 1, be movable or non-movable, and have an attachment to the housing of signaling device 1 at a higher or lower elevation than is shown in FIG. 1. The location of port 6 as shown in FIG. 1 is also not considered as critical, and may be in any convenient location on signaling device 1. It is preferred for top signaling component 2 to comprise at least one light emitting diode (LED), but other means of displaying visually distinctive lighting characteristics may also be used and should be considered a part of the present invention. The visually distinctive lighting characteristics from signaling component 2 must be easily viewable and interpreted from at least ten feet away. However, it may also be viewable from a hundred feet away, or more, if desired. The size, shape, and location of function control buttons 3 and 4, indicator lights 7, and port 6 may also be different from that shown in FIG. 1, as long as each can successfully fulfill its intended function. In addition, and although not shown, in place of a clip-shaped mounting device 5, it is also contemplated for clip 5 to be replaced b) double-sided adhesive tape or a stretchable band that temporarily secures device (1, 1', 1", or other) to an article or container 12 while routed through a facility. In a different embodiment, it is also considered to be within the scope of the present invention for the functions of controls 3 and 4 to be combined into a single interactive control.

Figure 2:
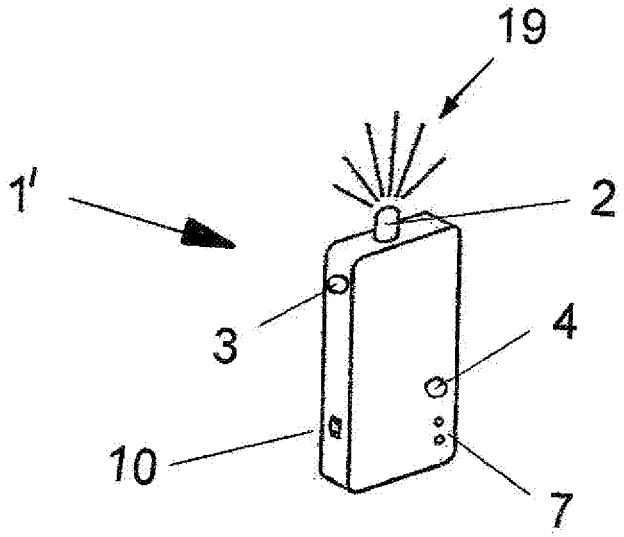
FIG. 2 is a perspective view from the front of a second preferred embodiment of the present invention signaling device with a top signaling component, forward and backup function buttons, and at least one indicator light that are similar to those shown in FIG. 1, and FIG. 2 additionally showing no rear mounting/attachment device, a lighted beacon, and a wireless programming port in place of the wired port shown in FIG. 1.

While FIG. 2 is a perspective view from the front of a second preferred embodiment 1' of the present invention signaling device with a top signaling component 2, forward and backup function buttons (3 and 4 respectively), and at least one indicator light 7 that are similar to those shown in FIG. 1, the main differences between it and first preferred embodiment 1 are the lack of rear mounting/attachment device 5, the inclusion of a wireless programming port 10 in place of the wired port 6 shown in FIG. 1, and its beacon 2 displaying a lighted signaling output 19. To attain a prominent and conspicuous location for beacon 2 to fulfill its signaling purpose, second preferred embodiment 1' could be placed in an outside pocket (not shown) on an article or container 12, but is not limited thereto. FIG. 3 is a perspective view from the front of a plurality of second preferred embodiments 1' each associated with a different container 12 on an automated conveyor system 11 so that its top signaling component 2 can be easily viewed in sequence by those next required to service container 12. When the worker at a destination sees a beacon 2 with specific signal lighting output 19 characteristics coded for that destination on display, and the article or container 12 associated with that beacon 2 is at least ten feet away, the worker has ample time to approach the automated conveyor system 11 and remove that specific article and container 12 for needed servicing. Until the next article and container 12 in association with a beacon 2 displaying the same coded signal lighting output 19 characteristics coded for that destination is observed, the worker would let all remaining articles and containers 12 remain on the automated conveyor system 11.

FIG. 4 is a perspective view from the front of a third preferred embodiment 1" of the present invention signaling device with a top signaling component 2, forward and backup function buttons (respectively 3 and 4), and at least one indicator light 7 that are similar to correspondingly numbered components shown in FIGS. 1 and 2, and a rear mounting device 5 in the form of a clip that is similar to that shown in FIG. 1. The third preferred embodiment 1" also has the wireless programming port 10 shown in FIG. 2, and additionally shows an informational display 8 on its front surface that provides information about the destination and task (or tasks) to be performed, as well as its clip-shaped rear mounting device 5 shown having a charging contact 9. A power source 20, preferably at least one rechargeable battery, is also shown in broken lines within third preferred embodiment 1" and near programming port 10. The housing/body of third preferred embodiment 1" is not considered to be, limited to the rectangular shape shown in FIG. 4, and other cross-sectional configurations are also considered as within the scope of the present invention.

Figure 5:
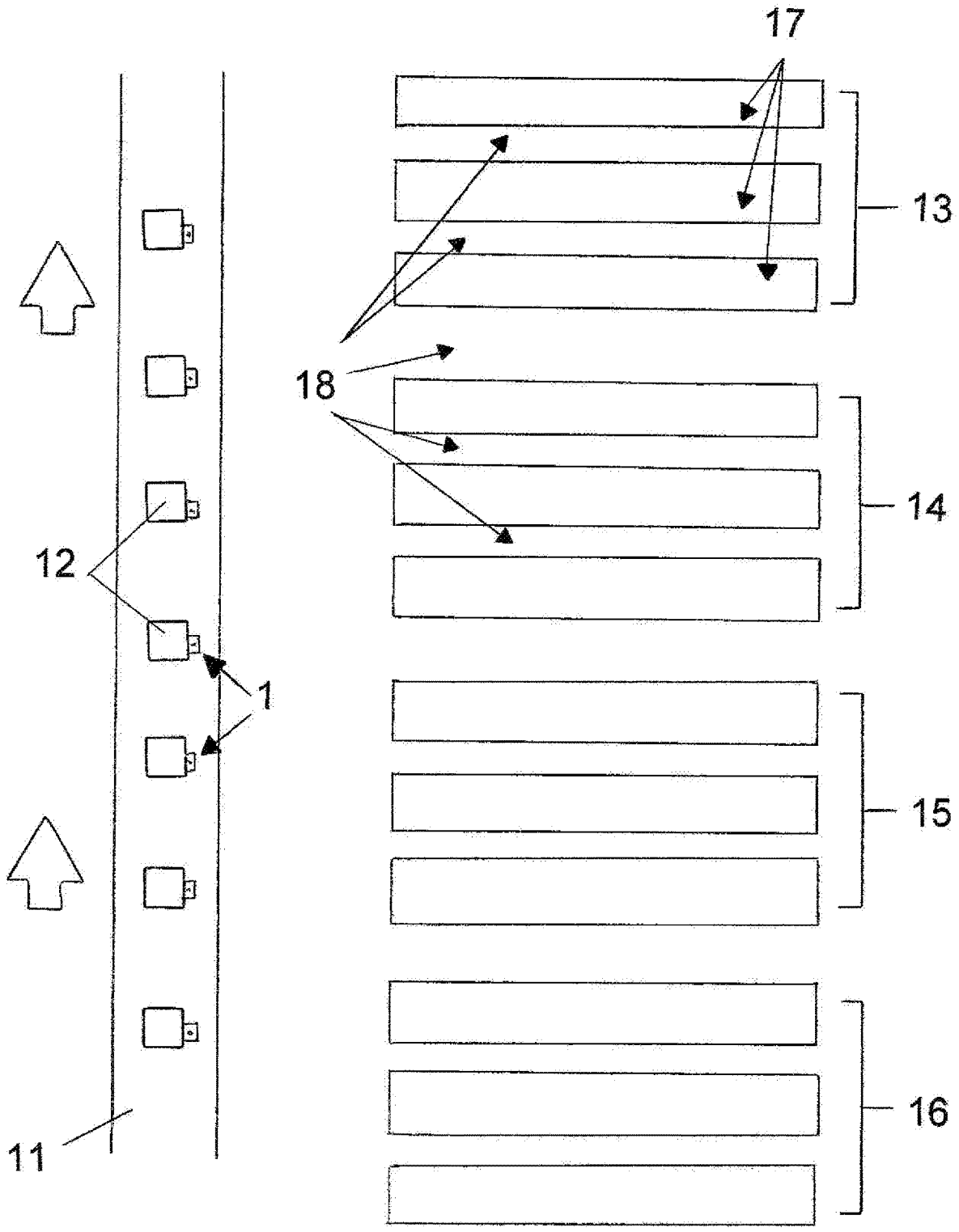
FIG. 5 is a top view of an automated conveyor having multiple containers each with an associated present invention device, and the conveyor routed near zones/aisles with shelving or bins, or other destinations where at least one order fulfillment task or service needs to be performed.

FIG. 5 is a top view of an automated conveyor system 11 having multiple containers 12 each with an associated present invention signaling device 1, and the conveyor 11 routed near aisles 18, storage shelves or bin 17, Performance Zones 13, 14, 15, and 16, where at least one order fulfillment task or service needs to be performed. Other destinations (not shown) are also contemplated for present invention signaling device (1, 1', 1", or other), such as but not limited to office buildings where items or paperwork need to be routed to differing locations for review and/or approvals. Although not shown in FIG. 5, two or more present invention signaling devices (1, 1', 1", or other) can be associated with a single container 12 on conveyor 11 as it is routed through a facility, each of the two or more present invention signaling devices (1, 1', 1", or other) displaying the same color of visual signaling output 19, or displaying different colors of visual signaling output 19 and/or other lighting characteristics.

Furthermore, although not shown, another example of a present invention signaling device 1 could be in the form of a very simple and cylindrical "flashlight" style housing with a single signaling component 2 that is controlled by one on/off/advance button (instead of using separate function controls 3 and 4). It is further contemplated that such an embodiment of the present invention signaling device 1 could be programmed and charged via a USB port built into the base of its housing. This cylindrical flashlight style embodiment of the present invention signaling device 1 would require either a printed information sheet (not shown) that corresponds to the sequence of servicing required for an associated item or container 12, or perhaps a scannable label or tag, or a separate electronic device (not shown) that is able to inform the user of present invention device 1 of each next servicing requirement until all servicing of item or container 12 is complete. It would be possible for each flashlight style embodiment to display a single color of light with variations provided via changing intensities, blinking patterns, and/or other distinguishing factors.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited only to the above-described embodiments, methods, and examples, but instead as encompassing all embodiments and methods identified in the accompanying claims, in addition to those within the scope and spirit of the invention and its equivalents.

I claim:

1. An efficiency-promoting electronic signaling device usable in business-to-business and business-to-customer operations where items and containers are moved within a facility to successive workstations each providing a service, said device comprising:

a compact housing;

at least one lighted signaling component associated with said housing and programmable to display one-at-a-time at least two visual signals in sequence, each said at least two visual signals having at least one distinguishable characteristic;

at least one human interface function control associated with said housing in electrical communication with said lighted signaling component, said at least one human interface function control changing said displayed visual signal characteristics of said lighted signaling component when engaged; and a programming port through said housing allowing storage of information within said housing that defines said at least two visual signals to be displayed in sequence by said at least one lighted signaling component, wherein when said programming port is used to store information defining characteristics of said at least two visual signals to be displayed in sequence by said at least one lighted signaling component, said at least two visual signals are each coded to identify a specific workstation within a facility, and when said device is associated with an item or container routed within the facility, each of said at least two visual signals in sequence alerts a next one of said workstations identified by codes present in said stored information to intercept the associated item or container to provide a service.

2. The device of claim 1 wherein said distinguishable characteristics of said visual signals are selected from a group consisting of differences in color, differences in light intensity, differences in light flashing duration, and differences in blinking patterns.

3. The device of claim 1 wherein said lighted signaling component comprises at least one light emitting diode.

4. The device of claim 1 wherein said lighted signaling component is associated with said housing, providing a maximum visibility of 360-degrees.

5. The device of claim 1 wherein said lighted signaling device is visible from a minimum distance of ten feet.

6. The device of claim 1 wherein said lighted signaling device is visible from a distance of at least one hundred feet.

7. The device of claim 1 further comprising an informational display screen associated with said housing.

8. The device of claim 1 wherein said programming port is selected from a group consisting of wired programming ports and wireless programming ports.

9. The device of claim 1 comprising two of said lighted signaling components with each of said signaling components programmed for a different service at one workstation.

10. The device of claim 1 further comprising at least one power source in electrical communication with said at least one lighted signaling component.

11. The device of claim 10 wherein said at least one power source is selected from a group consisting of single use batteries and rechargeable batteries.

12. The device of claim 1 wherein said at least one human interface function control when engaged provides changes in said displayed visual signal characteristics selected from a group of changes consisting of a change wherein said lighted signaling component is turned on to display a first visual signal, a change wherein said lighted signaling component is turned off so that no visual signal is displayed, a change wherein said lighted signaling component is advanced in sequence to display a new visual signal, and a change wherein said lighted signaling component is reversed in sequence to display a previously displayed visual signal.

13. The device of claim 1 further comprising at least one indicator light associated with said housing.

14. The device of claim 1 farther comprising a mount associated with said housing.

15. The device of claim 14 wherein said mount comprises a charging contact.

16. The device of claim 14 wherein said mount is a spring clip.

17. A method of using said device of claim 1, said method comprising the steps of:

a) providing at least one said device, a facility with a plurality of workstations, at least one item or container to be serviced, and routing means to transport said at least one said device and said at least one item or container to be serviced in association with one another to at least one of said workstations;

b) using said programming port through said housing in each said at least one said device to cause storage of coded information therein that defines said at least two visual signals to be displayed in sequence by said at least one lighted signaling component associated with said housing, said at least two visual signals each coded to alert a specific workstation within the facility about needed service for an associated item or container;

c) engaging said at least one human interface function control on said housing of at least one said at least one said device to cause said lighted signaling component to turn on and display a first visual signal;

d) associating at least one said at least one said device to each said item or container to be serviced;

e) routing each said item or container and said at least one said device associated with it through said facility to workstations for service, said workstations where said service is needed identified by said characteristics of said visual signals displayed;

f) once service at a workstation is performed, engaging said at least one human interface function control on said housing to cause at least one said at least one lighted signaling component to display new characteristics; and g) repeating said steps e) and f) until all needed service coded in said programmed information stored in said housing is complete.

18. The method of claim 17 wherein, said facility is selected from a group consisting of facilities conducting merchandise collection for order fulfillment, facilities requiring periodic restocking distribution, facilities performing product manufacture, and offices routing items or, documents to multiple locations for needed review and/or approvals.

19. The method of claim 17 wherein said steps c and d occur in reverse order.

20. The method of claim 17 further comprising a step of reprogramming said at least one said device for a next use, said step of reprogramming occurring after said step g).

* * * * *